US006889459B1

(12) United States Patent
Salvitti

(10) Patent No.: US 6,889,459 B1
(45) Date of Patent: May 10, 2005

(54) MODEL 1911 TYPE FIREARM SAFETY LOCK

(76) Inventor: Alfred W. Salvitti, 3 Scottsdale Rd., Lansdowne, PA (US) 19050

( * ) Notice: Subject to any disclaimer, the term of this patent is extended or adjusted under 35 U.S.C. 154(b) by 0 days.

(21) Appl. No.: 10/684,902

(22) Filed: Oct. 14, 2003

Related U.S. Application Data

(63) Continuation of application No. 09/837,922, filed on Apr. 18, 2001, now Pat. No. 6,647,655.

(60) Provisional application No. 60/263,906, filed on Jan. 24, 2001, and provisional application No. 60/198,525, filed on Apr. 19, 2000.

(51) Int. Cl.[7] ..... F41A 17/00

(52) U.S. Cl. ..... 42/70.08

(58) Field of Search ..... 42/70.08, 70.11

(56) References Cited

U.S. PATENT DOCUMENTS

| | | | |
|---|---|---|---|
| 689,283 | A | 12/1901 | Browning |
| 911,683 | A | 2/1909 | Scott |
| 1,972,763 | A | 9/1934 | Dutton |
| 2,169,084 | A | 8/1939 | Swartz |

(Continued)

FOREIGN PATENT DOCUMENTS

BR PI 8904218 A 2/1991

OTHER PUBLICATIONS

Springfield Armory Catalog, 2001, p. 14.

*Primary Examiner*—Michael J. Carone
*Assistant Examiner*—Troy Chambers
(74) *Attorney, Agent, or Firm*—Woodard, Emhardt, Moriarty, McNett & Henry LLP

(57) ABSTRACT

A firearm safety lock for an automatic pistol such as the Model 1911 firearm is disclosed. The safety lock includes a means of arresting the operation of the main trigger or hammer spring in the pistol grip of the firearm to prevent movement of the hammer, thereby locking the gun in a safe condition. A means and a method is disclosed for locking a pistol in a sale condition by arresting the movement of the hammer spring buffer through insertion of a locking shaft through the pistol grip housing which can be keyed to prevent unauthorized removal of the locking shaft. The disclosed invention may be used on newly manufactured firearms or provides a method to easily convert an existing firearm without permanent modification or damage to the firearm.

11 Claims, 2 Drawing Sheets

U.S. PATENT DOCUMENTS 2,691,232 A 2/1954 Hoopes
2,803,910 A 8/1957 Lyle
2,945,316 A 7/1960 Mulno
2,994,981 A 8/1961 Carrigan
3,462,869 A 8/1969 Wallace
3,673,725 A 7/1972 Cravener
3,750,531 A 8/1973 Angell et al.
3,762,089 A 10/1973 Meyer, Jr.
3,889,412 A 6/1975 Filecci
4,021,955 A 5/1977 Curtis
4,306,487 A 12/1981 Beretta
4,312,263 A 1/1982 Bourlet
4,575,963 A 3/1986 Ruger et al.
4,658,529 A 4/1987 Bertolini
4,672,763 A 6/1987 Cunningham
4,726,136 A 2/1988 Dornaus
4,763,431 A 8/1988 Allan et al.
4,845,870 A 7/1989 Vernon
4,947,730 A 8/1990 Byron
4,967,502 A 11/1990 Vernon
5,081,779 A 1/1992 Pack
5,090,147 A 2/1992 Pastor
5,225,612 A 7/1993 Bernkrant
5,229,532 A 7/1993 Brooks
5,235,763 A 8/1993 Nosler et al.
5,293,708 A 3/1994 Strayer et al.
5,320,023 A 6/1994 Erdem
5,361,525 A 11/1994 Bowes
5,517,780 A 5/1996 Haber et al.
5,570,527 A 11/1996 Felicci
5,581,927 A 12/1996 Meller
5,621,995 A 4/1997 Smith
5,625,971 A 5/1997 Tuma et al.
5,651,206 A 7/1997 Matarazzo
5,666,754 A 9/1997 De Oliveira Masina
5,671,560 A 9/1997 Meller
5,680,722 A 10/1997 French et al.
5,732,497 A 3/1998 Brooks
5,743,039 A 4/1998 Garrett
5,749,166 A 5/1998 Brooks
5,782,028 A 7/1998 Simon et al.
5,910,003 A 6/1999 Kleinpaul
6,205,694 B1 3/2001 Davis, Sr.
6,257,116 B1 7/2001 Moczijdlower et al.
6,269,576 B1 8/2001 Williams
6,283,006 B1 9/2001 Szabo et al.
6,647,655 B2 11/2003 Salvitti
6,691,445 B2 * 2/2004 Williams ..... 42/70.08

* cited by examiner

MODEL 1911 TYPE FIREARM SAFETY LOCK

This U.S. patent application is a continuation of U.S. patent application Ser. No. 09/837,922 filed on Apr. 18, 2001, now U.S. Pat. No. 6,647,655. THIS application also claims priority to U.S. Provisional Patent Application Ser. No. 60/263,906, filed Jan. 24, 2001 and to U.S. Provisional Patent Application No. 60/198,525, filed Apr. 19, 2000.

BACKGROUND OF THE INVENTION

The present invention relates to firearms, such as pistols, which use hammers which fire the pistol upon activation of a trigger mechanism. The disclosed invention will operate with such pistols which use a main spring or trigger spring which activates the movement of the hammer to fire the pistol. The disclosed safety lock device will work on any pistol design similar to the well-known 1911 style government pistol which utilizes a hammer spring which is located generally within the pistol grip of the firearm.

While safety selection switches and devices have been common on firearms for many years, there has recently been a move to provide for a lockable safety which adds a means to render the firearm safe using other than the operator selected safety switches or levers which are commonly found on many pistols, including the 1911 style pistol. There are a variety of pistol safety designs, such as the grip lever safety seen on the 1911 style pistol. The pistol described in U.S. Pat. No. 984,519, issued Feb. 14, 1911, to John M. Browning is still used today on the pistol styles which bear the general designation of the year of his invention. The purpose of this grip type of safety on pistols is to prevent the pistol from discharging when the pistol chamber is loaded, ready to fire and the pistol is not properly positioned in the hand of the shooter.

A second category of safeties are those which are manually activated or deactivated by the operator of the pistol using a selective lever or switch which are characteristically mounted on the frame of a pistol or in an area of the pistol where the shooter's thumb is positioned when the pistol is maintained in the proper method of gripping the pistol. Such manual safeties are positioned to allow their manipulation by the shooter, but are generally not designed to have a lock on device which will prevent the activation of the pistol by an unauthorized user.

With increased emphasis on pistol safety and in an effort to provide the means to lock a pistol to avoid activation by a child or other unauthorized user, many pistol locks which are separate, peripheral devices have been utilized. Such devices include blocking the barrel and the slide of the firearm with a mechanical means, or placing devices on or about the trigger area to prevent activation of the trigger, using key lock devices which can only be removed from the gun frame by insertion of the proper key.

Accordingly, it is the object of the present invention to provide a secure, lockable means to render a pistol in a safe, non-firing condition by disabling, arresting, or blocking the movement of the pistol hammer activation means through a lockable insertion device. It is a further object of the present invention to provide a means to arrest the movement of the main hammer spring in pistols utilizing hammer springs generally locating within the pistol grip, such as to selectively arrest the movement of the spring mechanism or spring components so that any spring bias used to activate the hammer mechanism is not available until the locking means is selectively removed. It is yet a further object of the present invention to provide a means to arrest a pistol's hammer activation rod by securing said rod to the spring activation means or buffer used to operate the pistol in a selective fashion to render the pistol in a safe or fire condition.

SUMMARY OF THE INVENTION

The disclosed invention relates to an internally operated safety device or safety lock designed to prevent firing of a Colt government model 1911 style semiautomatic pistol. The invention operates by selectively arresting the movement of the buffer device which sits atop the trigger spring contained within the pistol grip of the gun. The present invention provides a means to retrofit existing 1911 style semiautomatic handguns with the device without permanently altering or damaging the firearm. By utilizing existing internal components, and providing a modification of certain components which are easily replaceable, the disclosed invention provides for an effective means to lock down a firearm by replacement of certain modified parts. However, the firearm may be restored to its original condition by replacement of conventional, inexpensive parts, thereby allowing an owner of the firearm to install the safety device without any apprehension about destroying the value of the gun or permanently altering the major components of the firearm.

The invention operates by arresting or preventing the upward or downward travel of a spring buffer device which is located at the interface of an operating rod which connects the hammer mechanism with the main spring. The main spring provides the potential energy or spring bias, for the return of the hammer upon the activation of the trigger once the hammer has been cocked. The invention suggests a means to lock the firearm utilizing a simple screw type device. A more elaborate locking mechanism may be used to prevent removal of the locking device once engaged in the safe position. Such locking mechanisms form a basis for a key style firearm lock which is internal to the firearm.

DETAILED DESCRIPTION OF THE INVENTION

Figure 1:
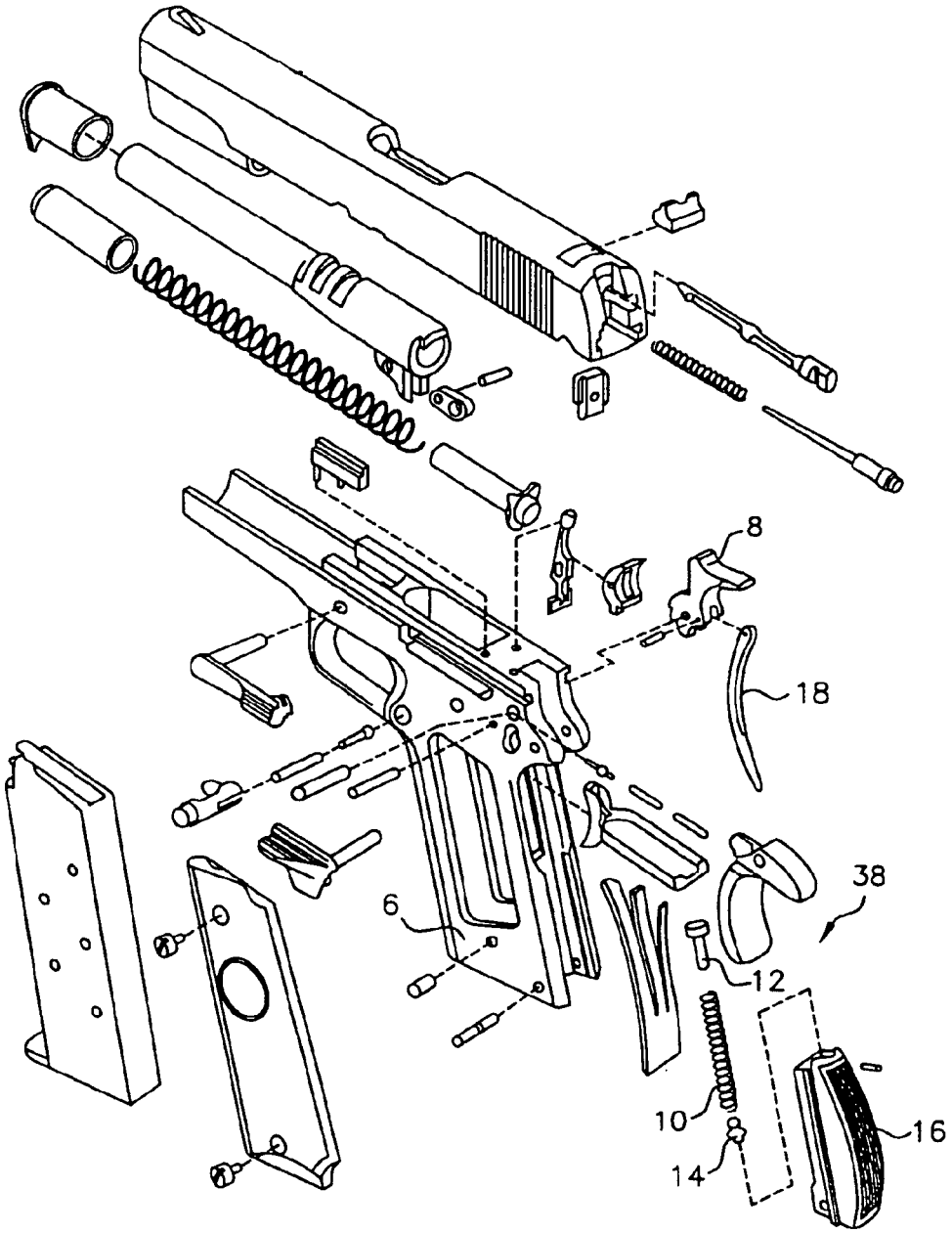
FIG. 1 is an exposed view of the typical Colt government model 1911 semiautomatic pistol illustrating all of the internal components of the firearm specifically detailing components of interest for the safety lock disclosed.

The invention will now be described with reference to the various figures in which like numbers refer to like parts for a typical model 1911 style handgun. Turing to FIG. 1, an exploded view of the pistol is seen utilizing parts which will seem familiar to gunsmiths and those skilled in the art. Turning to area 38 shown on FIG. 1, it will be appreciated by those familiar with firearms that a 1911 model semiautomatic handgun utilizes a main spring contained within the pistol grip area of the handgun. The hammer 8 is attached to the trigger spring operating rod 18. FIG. 1 discloses the operating rod separately in the exploded view, through it would be appreciated by those skilled in this art that rod 18 sits within an upper notch area of buffer 12 when the pistol is assembled. Upon cocking of the hammer 8, rod 18 presents force in the downward position and urges buffer 12, sitting within the coil of the spring 10, to compress or bias the spring. The compressed spring provides the energy to return the hammer upon actuation of the trigger mechanism.

The present invention operates by arresting the movement of buffer 12. It has been determined by the inventor that insertion of a stopping mechanism such as a set screw or some other device which prevents any upward or downward movement of buffer 12 will effectively lock down the firearm and prevent it from firing. The invention operates in this fashion because rod 18 is prevented from moving downward, thereby holding hammer 8 in the closed position. Pulling on the trigger in a double action model or attempting to cock the hammer backward to prepare the fire the firearm would be impossible when buffer 12 is arrested or locked with the device disclosed.

Figure 2:
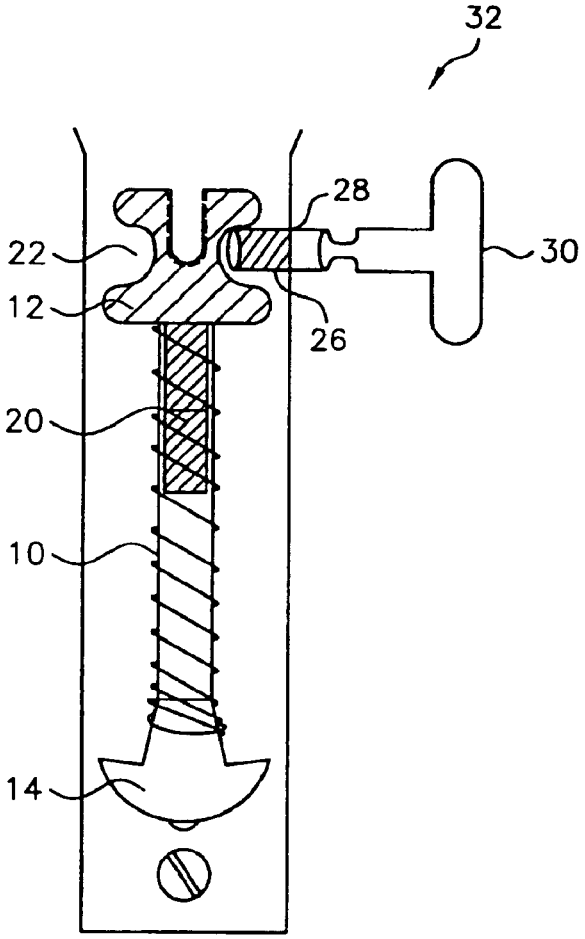
FIG. 2 provides a cutaway view of part of the pistol grip area of the Colt model 1911 style handgun illustrating the invention and the operation of the invention as it relates to the arresting of the main spring buffer and illustrates the lock mechanism in the on or safe position.

Turning to FIG. 2, a cutaway view of the pistol grip of the model 1911 style firearm shown spring 10 with spring buffer 12, a modified version, placed in its normal operating position. It can be appreciated by observing FIG. 2 that rod 18 sits within a notch provided at the top of buffer 12 in an identical fashion to that found on a stock firearm. However, buffer 12 has been modified to provide a slot about the entire circumference of buffer 12 in a fashion to allow the entry of buffer block or shaft 26. Buffer block 26 can be the end of a set screw inserted through threaded opening 28 and operated through key 30 such as the entire lock 32 is one unit inserted within the pistol grip at opening 26 to engage in the mating slot 22 found in buffer 12.

Although slot 22 in the spring buffer 12 may be located in one area of the buffer, it has been discovered by the inventor that upon operation of the firearm, buffer 12 may travel or rotate about its longitudinal axis through normal vibrations. A more effective mechanism is provided if the shape of the new buffer 12 has a uniform slot 22 around its entire circumference to engage block 26.

One of the advantages of the disclosed invention is that it may be utilized to retrofit numerous existing firearms of the style disclosed without damaging or permanently altering the firearm. Since many firearm owners prefer not to machine or permanently modify an existing, and usually expensive firearm, the invention disclosed can be utilized to make a kit which will fit into an existing firearm without having to damage or alter the firearm. By utilizing dimensions of buffer 12 that are similar to the existing dimensions of typical spring buffer in the 1911 pistol, and by providing replacement parts for the grip spring housing 16 which is integrated into the pistol grip, it can be appreciated that components can be provided which can be easily installed by a firearm owner, or by any gunsmith without spending a great deal of time. Further, it can be appreciated that while FIG. 2 presents one style for providing a locking means or an arresting means to prevent movement of spring buffer 12, a variety of existing locking mechanisms can be installed such that locking shaft or block 26 is disposed to flush with the pistol grip housing and can contain a key lock or latcheting mechanism which requires a specially machined or formed key lock 30 to mate with the locking mechanism to prevent unlocking the device without having the mating key. Thus, it can be appreciated that using the method disclosed a variety of existing locking mechanisms to arrest buffer 12 will effectively provide a permanent safety lock for the firearm.

Figure 3:
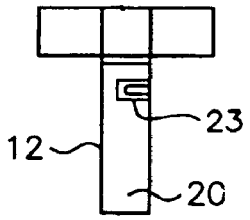
FIG. 3 is a diagram of a main spring hammer buffer device utilizing pin hole locking modification to be used on an alternate embodiment of the present invention.

In a Colt Commander, one style of a model 1911 firearm, buffer 12 should be increased in vertical length by approximately ⅛ inch while the operating spring 10 should be shortened by approximately ⅛ inch. It will be appreciated by those skilled in the art that the components that operate the firearm's hammer could be adjusted such that any new components added would not change the overall dimensions of the internal operating components. FIG. 3 illustrates a spring buffer 12 for the present invention which provides an alternative embodiment. It is possible to design a spring buffer 12 which utilizes a single spring buffer key hole 23 in the trigger spring buffer tail 20. In a firearm of similar design where spring buffer 12 does not rotate about the longitudinal axis of spring buffer tail 20, single notched areas of buffer tail 20 can be utilized to accept locking shaft 26 used to arrest movement of the buffer.

Turning again to lock 32 shown in FIG. 2, it can be further appreciated that lock 32 can be made up of a mechanism which will not allow withdrawal by the turning of knob 30 unless a keyed device or specialized tool is applied to unscrew the device or otherwise release a ratcheting mechanism which withdraws buffer block 26. Such a device could be a simple miniature key lock mechanism, a combination lock integrated into the handle of the gun, or some other snap lock ratcheting mechanism, much like that used in a ball point pen, to withdraw and extend the ball point sequentially.

The advantage of the present invention is that it does not affect the operation or the accuracy of the firearm, does not change the trigger pull or hammer operation and otherwise may be both retrofit into existing firearms and integrated as an option into new firearms while still allowing retrofit of both old and newly manufactured firearms.

In the preferred embodiment, the inventor has placed entry thread 28 at the rear of the pistol grip spring housing 16 as shown in FIG. 1. The manufacturers of the style of firearm displayed in the present disclosure allow quick change of different styles of the rear of the pistol grip depending on the comfort or desires of the owner of the firearm. Lock 32 has been inserted into a drilled and tapped entry to allow engaging buffer 12 as modified. However, it can be appreciated by those skilled in the art of firearms manufacture or maintenance that a lock unit 32 may be inserted from one side or the other of the pistol grip and still operate to engage and arrest buffer 12. The inventor has determined that a preferred area for entry of the arresting device which comprises lock 32 is the rear of the grip trim spring housing 16.

The present invention relates not only to an improvement in the 1911 style pistol, but also provides a method for converting such a pistol which is already in existence. The invention described is easily retrofitted into any of the millions of existing 1911 style pistols so that such pistols can gain the benefit of a child-proof safety lock mechanism. With the described invention, anyone skilled in the art will recognize that an existing firearm can be modified as follows. First, remove the existing grip panels as shown in FIG. 1, which is easily accomplished by removing the screws. Removing such panels thereby provides easier access to the interior of the pistol handle area containing spring buffer 12 and the trigger or hammer spring 10. The spring and buffer are contained within the grip spring housing 16 which can easily be removed.

Next, after removal of the existing spring buffer 12, a modified buffer containing the modifications illustrated in FIG. 2 or 3 is then placed within the firearm to replace the existing buffer 12. Next, a modified spring housing grip piece 16 containing an opening to accept the locking shaft to mate with the indentation in the modified spring buffer 12. Grip 16 can contain a key lock device which upon activation inserts the described blocking mechanism to arrest the movement of the modified spring buffer 12 is then installed. Thereafter, reassembly of the pistol will provide for an operating firearm which is undamaged and can be modified back to its original stock condition if desired by the owner. The modified grip 16 housing the spring and buffer mechanism can be a newly machined unit containing an integrated key lock 32 or a modified original grip if the owner does not desire to maintain the option of replacing the original firearm parts.

And thus is described details of the best mode to carry out the invention. Though the invention has been described with respect to one embodiment, the true scope of the invention should not be limited by the examples provided in the specifications and drawings, but should be determined by the broadest reasonable interpretation of the language of the claims including reasonable structure on functional equivalents of that specifically claimed below.

What is claimed is:

1. An apparatus for disabling a firearm, the firearm including a hammer having a hammer strut extending therefrom, the hammer movable between a cocked position and an uncocked position, a trigger assembly for releasing the hammer from the cocked position upon actuation of the trigger assembly, and a spring positioned within a well of a spring housing, the spring being tensioned upon cocking of the hammer to provide energy to the hammer, the apparatus comprising:

a spring cap having a head portion positioned on the spring, the hammer strut having an end abutting said head portion of said spring cap;

a body received within a bore in the spring housing, and if the hammer is in the uncocked position said body is movable from a first position to a second position wherein said body blocks movement of said head portion of said spring cap.

2. The apparatus of claim 1, wherein said head portion includes:

a cup portion, said cup portion receiving the end of the hammer strut;

a shoulder abutting said spring opposite said cup portion; and a groove between said cup portion and said shoulder.

3. The apparatus of claim 2, wherein said body is cylindrical and has a first end, an opposite second end and a length extending therebetween.

4. The apparatus of claim 3, wherein said second end is positioned adjacent said spring cap when said body is in said first position.

5. The apparatus of claim 2, wherein said body is received within said groove of said spring cap when said body is in said second position and the hammer is in the uncocked position.

6. The apparatus of claim 2, wherein at least a portion of said body is threaded and rotatably received within said bore for movement from said first position to said second position.

7. The apparatus of claim 1, wherein said body is cylindrical and has a first end, an opposite second end and a length extending therebetween.

8. The apparatus of claim 2, wherein said first end of said body includes means for engaging a tool for moving said body between said first and second positions.

9. An apparatus for disabling a firearm, said firearm including a hammer movable between a cocked position and an uncocked position, a trigger assembly connected with the hammer for releasing the hammer from the cocked position upon actuation of the trigger assembly, and a spring positioned within a well of a spring housing, the spring being tensioned upon cocking of the hammer to provide energy to the hammer upon actuation of the trigger assembly, the apparatus comprising:

a hammer strut connected at one end with the hammer and having a length extending to an opposite end;

a spring cap having a head portion positioned on the spring, the opposite end of said hammer strut abutting said spring cap;

a disablement mechanism received within a bore in the spring housing, said disablement mechanism movable from a first position where the firearm is enabled to a second position wherein said disablement mechanism contacts said head portion of said spring cap where the firearm is disabled.

10. The apparatus of claim 9, wherein said head portion includes a top surface abutting the opposite end of said hammer strut, an opposite shoulder abutting said spring, and a groove between said top surface and said shoulder.

11. An apparatus for disabling a firearm, the firearm having a hammer movable between a cocked position and an uncocked position, and a spring positioned within a well of a spring housing, the spring being tensioned when the hammer is cocked, the apparatus comprising:

a spring cap having a head portion positioned on the spring, the hammer being connected with said spring cap; and a body received within a bore formed in the spring housing, said body having a first end and an opposite second end and a length extending therebetween, said body being movable from a first position where the firearm is enabled to a second position wherein contact between said body and said head portion of said spring cap disables the firearm.

* * * * *